US006061000A

United States Patent [19]

Edwards

[11] Patent Number: 6,061,000

[45] **Date of Patent: *May 9, 2000**

[54] DOWNHOLE DATA TRANSMISSION

[75] Inventor: Jeffrey Charles Edwards, Aberdeen, United Kingdom

[73] Assignee: Expro North Sea Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/765,602

[22] PCT Filed: May 23, 1995

[86] PCT No.: PCT/GB95/01174

§ 371 Date: Feb. 3, 1997

§ 102(e) Date: Feb. 3, 1997

[87] PCT Pub. No.: WO96/00836

PCT Pub. Date: Jan. 11, 1996

[30] Foreign Application Priority Data

Jun. 30, 1994 [GB] United Kingdom ..... 9413141

[51] Int. Cl.[7] ..... G01V 3/00

[52] U.S. Cl. ..... 340/854.6; 340/854.3; 166/250.01; 175/40

[58] Field of Search ..... 340/854.6, 354.8, 340/855.8; 166/250.01; 175/40, 50

[56] References Cited

U.S. PATENT DOCUMENTS

| | | | |
|---|---|---|---|
| 5,008,664 | 4/1991 | More et al. | 340/854.6 |
| 5,396,232 | 3/1995 | Mathieu et al. | 340/854.6 |
| 5,512,889 | 4/1996 | Fletcher | 340/854.6 |

FOREIGN PATENT DOCUMENTS

| | | |
|---|---|---|
| 1835576 | 10/1976 | Australia . |
| 2654577 | 5/1979 | Australia . |

*Primary Examiner*—J. Woodrow Eldred
*Attorney, Agent, or Firm*—Gifford, Krass, Groh, Sprinkle, Anderson & Citkowski, P.C.

[57] ABSTRACT

Apparatus for enabling electric signals to be transmitted between a device such as a sonde (46) positioned inside a tubing (38) of a well (30) and a region outside the tubing. In a preferred embodiment the apparatus comprises a transmitter coil (58) in the sonde (46) and a receiver coil (42) coupled to the tubing (38). The sonde (46) is coupled via wireline (48) to the surface and the receiver coil (42) is also coupled to the surface via a permanently installed cable (44). At least one measurement instrument (56) is located in the sonde such that measurement signals passed to said transmitter (58) are coupled to said receiver coil (42) and to the surface. The transmitter and receiver permit bidirectional communication and electrical power can be transmitted from the surface via said permanently installed cable such that single-phase or multi-phase power can be transmitted to drive downhole equipment, which may be coupled to the sonde.

21 Claims, 2 Drawing Sheets

DOWNHOLE DATA TRANSMISSION

The present invention relates to downhole data transmission and in particular to an apparatus and method for transmitting data from the bottom of a well to the surface.

It is often of crucial importance in the oil and gas production industry to be able to obtain real-time data from the bottom of a well. For example, during testing of a new well it is essential to be able to obtain transient pressure build up readings whilst during actual production operations it is highly desirable to have access to downhole parameters such as pressure, temperature and flowrate which allow production decisions to be made which affect well life and productivity.

Obtaining the required data from the bottom of a well requires the location of measurement gauges at the appropriate positions in the well. One location technique commonly used is to permanently locate measurement gauges in the tubing so that they are lowered into the well with tubing. Data is transferred from the gauges to the surface of the well via a permanently installed cable. Whilst this arrangement enables continuous, real-time, surface readout, it requires that the sensitive measurement gauges endure long-term exposure to a highly aggressive environment and failure of the gauges means a total loss of data requiring that well production be shut down until the tubing with the gauges can be recovered, repaired or replaced and relocated. It will be appreciated that this arrangement is unsatisfactory as shutting down an active well for any significant length of time causes significant losses to be incurred by the well operator.

Figure 1:
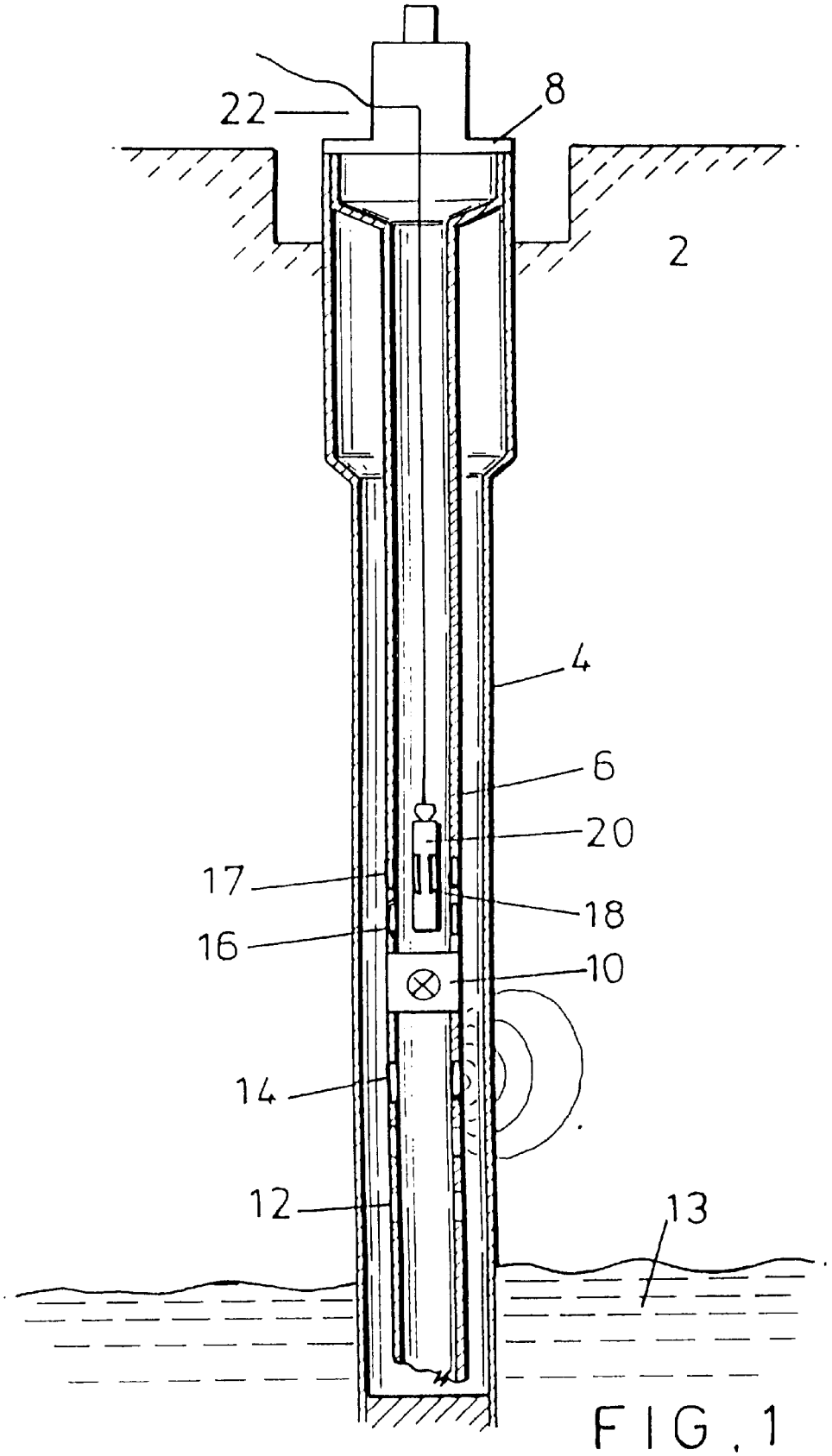

FIG. 1 shows an existing system for transmitting data between a set of measurement gauges 12 and the well surface, where the bore of the tubing 6 has an annulus pressure operated DST formation tester ball valve 10 which, when closed, isolates the well bore from the formation 13. The gauges below the valve are coupled to a coil, which transmits the gauge data above the valve for reception by a first ESIS coil 16 located in the tubing. The first coil 16 then transmits the data onto a second coil 17 which, in turn, transmits the data to an ESIS coil 18 mounted on a sonde 20 suspended in the well by a cable 22.

Other known techniques for installing measurement gauges include a slickline installation and carrier mounting.

It is an object of the present invention to overcome, or at least mitigate, certain of the disadvantages of the known techniques for obtaining downhole data transmission and in particular to enable downhole measurements to be made in real-time and to enable faulty measurement gauges to be replaced quickly and easily without requiring a complete shut down of the well for any significant period of time.

It is a further, or alternative, object of the invention to enable electric power to be supplied to a downhole apparatus positioned using a wireline in a manner which enables the apparatus to be quickly removed but which does not interfere with the normal operation of the well.

According to a first aspect of the present invention there is provided apparatus for enabling electric signals to be transmitted between a device positioned inside tubing of a well and a region outside the tubing, the apparatus comprising a transmitter of and a receiver of electromagnetic radiation, the transmitter being arranged to be located on said device or in said region outside the tubing and the receiver being arranged to be located on, or in, the other of said device and said region.

In a first embodiment of the invention, said apparatus is arranged to enable data to be transmitted from the sonde, on which is mounted at least one measurement device, to the surface of the borehole via receivers in the tubing. Preferably, the transmitter comprises a first coil coupled to the sonde and the receiver comprises a second coil, which may be an ESIS coil, coupled to the tubing the receiver being arranged to be in electrical communication with the surface of the borehole via a permanently installed cable. The transmitter and receiver may additionally have the capacity to receive and transmit respectively so as to enable bidirectional communication between the sonde and the surface.

A preferred additional feature of the first embodiment makes use of the transmitter for coupling to the tubing, or an additional transmitter for coupling to the tubing, for transmitting electrical power to the sonde for powering the measurement device. The sonde may include a rechargeable battery for storing the power receiving via the receiver or via an additional receiver.

In a second embodiment of the invention, said apparatus is arranged to couple electrical power from the transmitter to the receiver for powering said device, the transmitter being electrically coupled to the surface via a permanently installed cable. The transmitter and receiver may each comprise a single coil for the transfer of single phase power or a multi-coil arrangement for the transfer of multi-phase power. This second embodiment is particularly useful for powering an electrical submersible pump, of the type used for extending well life or increasing well production, removeably located downhole using a wireline process. The use of this embodiment may considerably reduce the well shut down time required for repairing or replacing a faulty pump.

According to a second aspect of the present invention there is provided a method of transmitting electrical signals between a device located inside the tubing of a well and a region outside the tubing, the method comprising:

disposing one of a transmitter and a receiver on a tool disposed in said tubing, disposing the other of said transmitter and receiver outside said tubing, locating said tool in said well so that said transmitter and said receiver are located so as to maximise coupling of electromagnetic radiation therebetween, and transmitting electromagnetic radiation between said device and said region outside the tubing.

The method preferably comprises positioning the device downhole, using a wireline, so that the means for transmitting and receiving are substantially adjacent one another.

In a first embodiment of the second aspect of the present invention, the method comprises transmitting measurement data generated by the device to a receiver attached to, or located outside, the tubing and then transmitting the data from the receiver to the surface via a permanently installed cable.

In a second embodiment of the second aspect of the present invention, the method comprises powering said device by coupling power between the surface and a transmitter, i.e. a first, single or multi-phase, coil arrangement, via a permanently installed cable, and inductively coupling power from the first coil arrangement to a corresponding second, single or multi-phase, coil arrangement.

It is a further, or alternative, object of the invention to enable electric power to be supplied to a downhole apparatus positioned using a wireline in a manner which enables the apparatus to be quickly removed but which does not interfere with the normal operation of the well.

Figure 2:
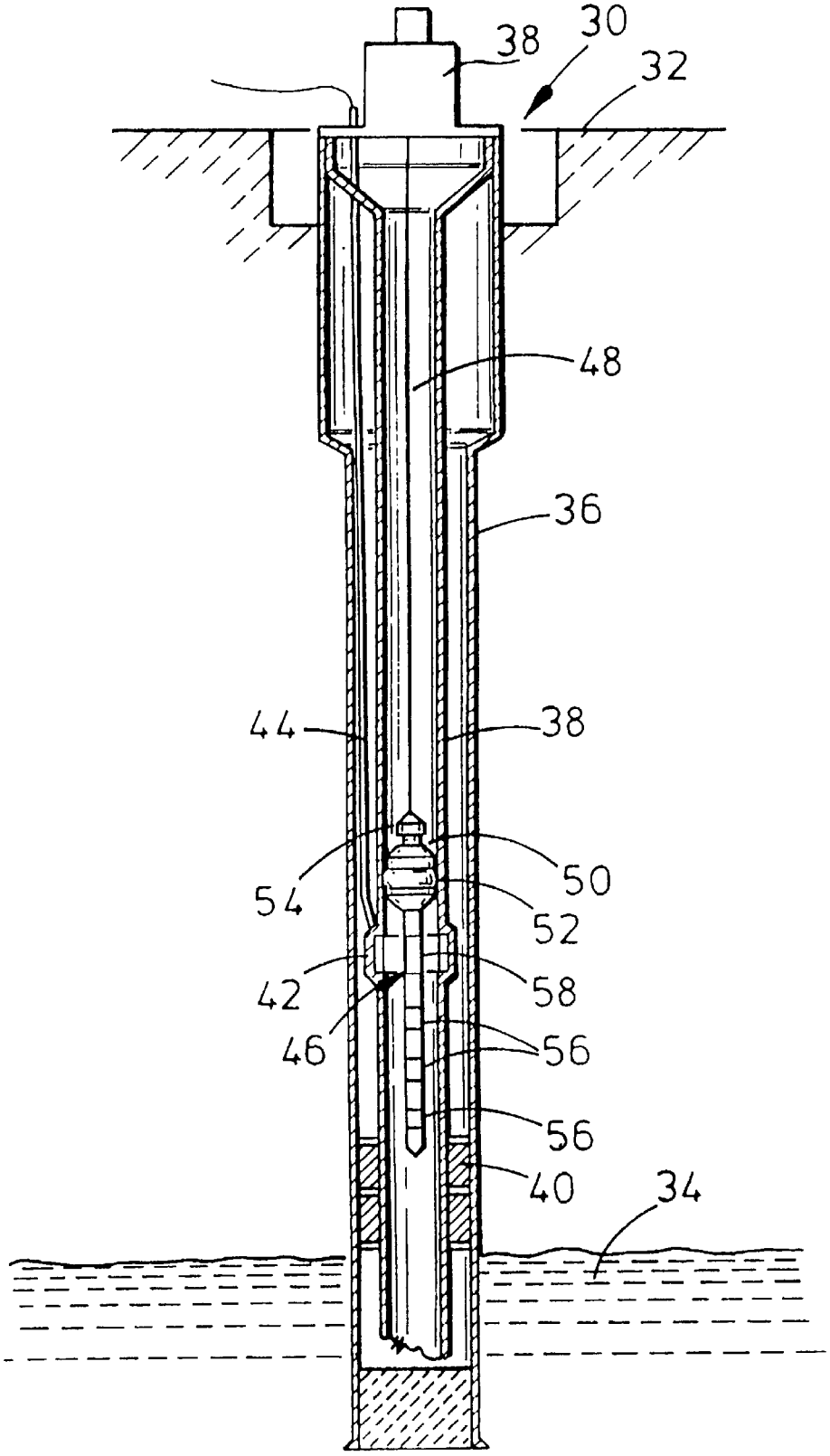

These and other aspects of the present invention will become apparent from the following description taken in combination with the accompanying drawings in which:

FIG. 2 shows an embodiment of the present invention enabling data transmission between a sonde mounted on a wireline and carrying a plurality of measurement devices and the surface.

There is shown in FIG. 2 a typical layout of a well 30 running from the surface 32 to a subterranean hydrocarbon reservoir 34. The well 30 is internally cased with a casing 36, with a tubing string 38 being run into the well 30 from a surface tree 38 for the purpose of transmitting fluid from the reservoir 34 to the surface 32. A packer 40 is positioned near the bottom of the well between the tubing and the casing, as is well known, to ensure that reservoir fluid is confined to flow within the tubing.

At an appropriate downhole location, a radio frequency receiver coil (ESIS) 42 is located in the tubing. The receiver coil 42, which is run into the well together with the tubing, may be of the ESIS type as is known in the art and is coupled to the surface via a permanently installed cable 44 located between the tubing string 38 and the casing 36. In order to permit measurements of reservoir parameters to be made, a sonde 46 is run into the tubing 38 on a wireline 48. The sonde 46 includes a wireline lock 50 for engaging a wireline nipple 52 on the inner surface of the tubing 38 so that the sonde 46 can be accurately installed at an appropriate measurement position. The wireline releasably engages a connector member 54 provided on the upper end of the sonde 46 so that the wireline 48 can be removed from the tubing 38 once the sonde 46 is correctly positioned.

The sonde 46 includes a plurality of measurement instruments 56 located at its downstream end to enable pressure, temperature and flowrate measurements, for example to be taken. The instruments 56 are coupled to a radio frequency transmitter coil 58 located on the sonde 46 upstream of the instruments. The sonde 46 is positioned in the tubing 38 such that the transmitter coil 58 is substantially adjacent the receiver coil 42 located in the tubing to facilitate communication between the coils 58,42 by inductive coupling.

Transmitted signals are detected by the receiver coil 42 and transmitted to the surface via the permanent cable 44. In addition, the arrangement may be such as to enable data to be transferred from the surface to the sonde via the inductive link, i.e. to enable bidirectional communication.

The sonde 46 comprises a power supply means (not shown in FIG. 2) for powering the measurement instruments 56 and the transmitter coil 58. An additional feature of the embodiment is the ability to transfer power, for example to recharge batteries of the sonde power supply, from the surface using the inductive link. Using such an arrangement instruments can be located downhole for long periods of time without the requirement for maintenance.

It will be apparent that the present invention can be applied to any system in which electrically powered instruments can be located downhole using wireline installation techniques. For example, it is common practice, as well productivity decreases, to install some form of reservoir flow enhancement technique to improve well performance. The most common method is to install an electrically powered submersible pump in a location in the lower section of the production tubing to increase the pressure and hence improve the flow of reservoir fluids from the well. A major problem with this approach, however, is that the service life of the pump is normally limited to between 1 and 2 years and is often considerably less. To replace the pump it is necessary to kill the well and retrieve the tubing, an operation which can take as long as 10 to 30 days. Such a shut down period representing a significant cost to the producer in terms of both lost production and expenditure on equipment and manpower.

Normal downhole installation techniques, i.e. via a wireline process, such as are used to install safety valve plugs etc., cannot be used with conventional electrical submersible pumps as these pumps require a power cable to be run down the annular space formed between the tubing and the well casing.

In order to overcome this problem, multi-phase power can be supplied via a permanently installed power cable to corresponding dedicated power coils attached to the inside of the tubing just below a nipple used for locating a pump. The pump is run into the well on a wireline and is located off in the nipple. The pump comprises receiving coils which, when the pump is in the desired location, lie adjacent corresponding ones of the power coils attached to the inside of the tubing. When A.C. current is supplied to the power coils of the tubing a proportional current is generated in the receiver coils to drive the pump. This arrangement allows the pump to operate substantially in physical independence of the power cable allowing the pump to be retrieved by standard wireline techniques.

Pump data and/or surface control instructions may be transmitted from and to the pump using the arrangement described above with reference to FIG. 2. The transmission and reception coils may comprise the power coils themselves or may be additional thereto.

It will be appreciated that various modifications may be made to the embodiments hereinbefore described without departing from the scope of the invention.

I claim:

1. Apparatus for enabling electric signals to be transmitted between a device positioned inside tubing within a borehole of a well and a region outside the tubing, the apparatus comprising a transmitter of and a receiver of electromagnetic radiation, the transmitter being arranged to be located on one of said device and an inner surface of the tubing and the receiver being arranged to be located on the other of said device and said inner surface of said tubing.

2. Apparatus as claimed in claim 1 wherein said device inside the tubing is a sonde and said apparatus is arranged to enable data to be transmitted from the sonde, said sonde having at least one measurement device mounted thereto, to a surface of the borehole via said receiver disposed on the inner surface of the tubing.

3. Apparatus as claimed in claim 2 wherein the transmitter comprises a first coil coupled to the sonde and the receiver comprises a second coil, coupled to the tubing, the receiver being arranged to be in electrical communication with the surface of the borehole via a permanently installed cable.

4. Apparatus as claimed in claim 2 wherein the transmitter comprises a first coil coupled to the sonde and the receiver comprises a second coil, coupled to the tubing, the receiver being arranged to be in electrical communication with the surface of the borehole via a permanently installed cable.

5. Apparatus as claimed in claim 4 wherein said second coil is a radio frequency receiver cable coil.

6. Apparatus as claimed in claim 2 wherein the sonde includes a rechargeable battery for storing the power received via the receiver.

7. Apparatus as claimed in claim 1 wherein said apparatus is arranged to couple electrical power from the transmitter to the receiver for powering said device, the transmitter being electrically coupled to a surface of the borehole via a permanently installed cable.

8. Apparatus as claimed in claim 7 wherein the transmitter and receiver each comprise a single coil for the transfer of single phase power.

9. A method of transmitting electrical signals between a device located inside tubing within a borehole of a well and a region outside the tubing, the method comprising:

disposing one of a transmitter and a receiver on an inner surface of said tubing, disposing the other of said transmitter and receiver on said device, positioning said device in said tubing so that said transmitter and said receiver are located substantially adjacent each other so as to maximise coupling of electromagnetic radiation therebetween; and transmitting electromagnetic radiation between said device and said region outside the tubing.

10. A method as claimed in claim 9 including the steps of positioning the device downhole, using a wireline, so that the means for transmitting and receiving are substantially adjacent one another.

11. A method as claimed in claim 9 wherein the method comprises transmitting measurement data generated by the device to the receiver, said receiver being disposed on the inner surface of said tubing, and then transmitting the data from the receiver to the surface via a permanently installed cable.

12. A method as claimed in claim 9 wherein said method includes the steps of powering said device by coupling power between the surface and the transmitter, namely a first coil arrangement, via a permanently installed cable, and inductively coupling power from the first coil arrangement to a corresponding second, coil arrangement.

13. A method as claimed in claim 9 wherein the device is a pump.

14. Apparatus as claimed in claim 7 wherein the transmitter and receiver each comprise a multi-coil arrangement for the transfer of multi-phase power.

15. Apparatus as claimed in claim 1, wherein the device includes a rechargeable battery capable of receiving and storing power received via the transmitter and receiver.

16. Apparatus as claimed in claim 1, wherein the one of the receiver or transmitter located on the bore of the tubing is arranged to be in electrical communication with a surface of the borehole via a cable permanently installed with the tubing.

17. Apparatus as claimed in claim 8, wherein the cable is located in an annulus between the tubing and a well casing.

18. Apparatus as claimed in claim 1, wherein the device is positioned inside the tubing by means of an assembly, which assembly does not include a tubing valve.

19. Apparatus as claimed in claim 1, wherein the device is a pump.

20. A method as claimed in claim 9, further comprising before transmitting electromagnetic radiation, electrically connecting the one of the transmitter or receiver disposed on the inner surface of the tubing with said surface of the borehole via a cable located in an annulus between the tubing and a well casing.

21. Apparatus as claimed in claim 6, further comprising an additional receiver wherein said rechargeable battery stores power received via one of the receiver and said additional receiver.

* * * * *